United States Patent [19]

Griffin

[11] Patent Number: 4,707,877

[45] Date of Patent: Nov. 24, 1987

[54] WET MOP LIQUID EXTRACTOR

[75] Inventor: Dana K. Griffin, Van Wert, Ohio

[73] Assignee: Tu-Way Products Company, Troy, Mich.

[21] Appl. No.: 879,146

[22] Filed: Jun. 26, 1986

[51] Int. Cl.[4] ..... A47L 13/59

[52] U.S. Cl. ..... 15/261; 68/241; 100/233

[58] Field of Search ..... 15/260, 263, 105, 257 R; 100/219, 233; 68/241

[56] References Cited

U.S. PATENT DOCUMENTS

| | | | |
|---|---|---|---|
| 1,500,058 | 7/1924 | Courtemanche | 15/261 |
| 3,795,939 | 3/1974 | Seufert | 15/261 |
| 4,493,492 | 1/1985 | Balabanova | 15/260 X |
| 4,528,717 | 7/1985 | Osberghaus et al. | 15/261 |
| 4,663,798 | 5/1987 | Sacks et al. | 15/261 |

*Primary Examiner*—John Petrakes

*Attorney, Agent, or Firm*—Robert G. Mentag

[57] ABSTRACT

A wet mop liquid extractor having a rollable support frame carrying a fixed arcuate pressure plate for supporting a wet mop from which liquid is to be extracted, and a movable pressure plate adapted to be brought into pressing contact with the wet mop on the fixed pressure plate in a rolling type manner to maximize the squeezing pressure on the mop to extract the liquid therefrom, and a bucket is carried on the support frame beneath the fixed pressure plate to catch the liquid extracted from the wet mop.

7 Claims, 12 Drawing Figures

WET MOP LIQUID EXTRACTOR

BACKGROUND OF THE INVENTION

1. Technical Field

The field of art to which this invention pertains may be generally located in the class of devices relating to mops. Class 15, entitled Mops and Mop Making, appears to be the applicable general area of art to which subject matter similar to this invention have been classified in the past.

2. Background Information

The wet mop wringers available on the marketplace squeeze or press the yarn of a wet mop by various means, either by means of rollers or pressing the wet mop against a stationary member in a pail. Such prior art mop wringers are for mops involving the use of long yarn. Attempts have been made to use wet mops having mop heads with short yarn, but no prior art wet mop wringers has been provided for effectively squeezing or extracting liquid from a short yarn wet mop.

SUMMARY OF THE INVENTION

In accordance with the present invention, a short yarn wet mop liquid extractor is operatively mounted on a movable support cart for quickly and easily extracting liquid from a short yarn wet mop head, without taking the mop head off of the mop head holder. The support cart includes a support frame which is provided with roller means, and a platform for holding a pair of laterally spaced apart pails for holding liquid. The pails are disposed in a front and rear disposition adjacent to each other. The front pail is provided with clean water to which may be added any desired germicidal or chemical. The rear pail functions as a catch pail for catching liquid extracted from a short yarn wet mop by the extraction means of the present invention. An extraction means is operatively mounted on the support cart in a position over the rear pail, and it includes an arcuate, fixed, perforated pressure plate for the reception of a short yarn wet mop head.

In use, a new wet mop head would be put on a mop holder and immersed in the fluid in the front bucket and it would then be placed on the fixed pressure plate. A movable pressure plate is operatively mounted on the support frame in a position above the fixed pressure plate. The movable pressure plate is then moved in an arcuate and rolling path over the fixed pressure plate and it engages the mop placed on the fixed pressure plate and it extracts the liquid therefrom which then falls downwardly into the rear pail. The movable pressure plate is moved throughout an operative pressure cycle by means of a lever mounting means which is operated by a foot pedal.

DESCRIPTION OF THE PREFERRED EMBODIMENT

Figure 1:
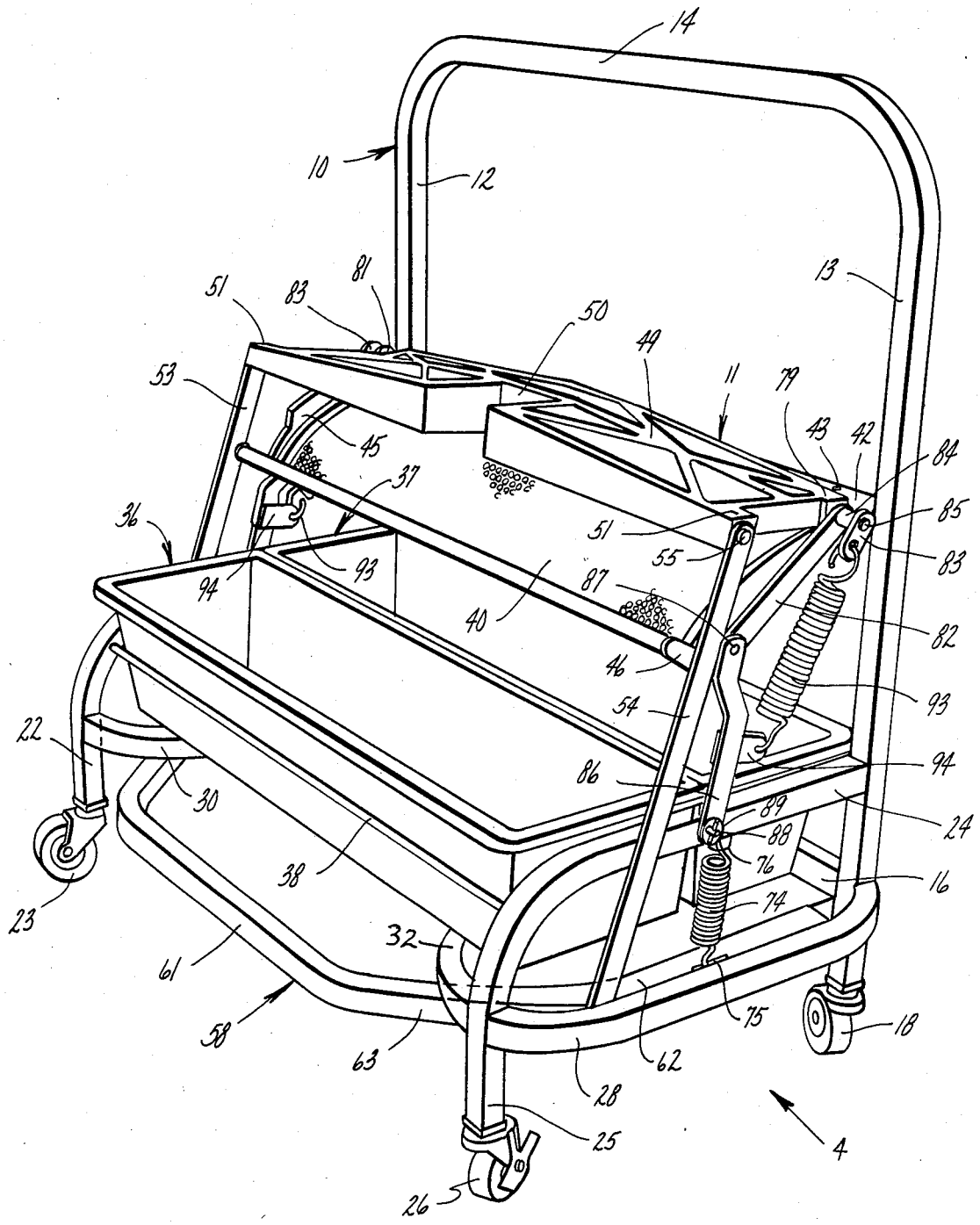
FIG. 1 is an elevation perspective view of a wet mop liquid extractor made in accordance with the principles of the present invention.
Figure 2:
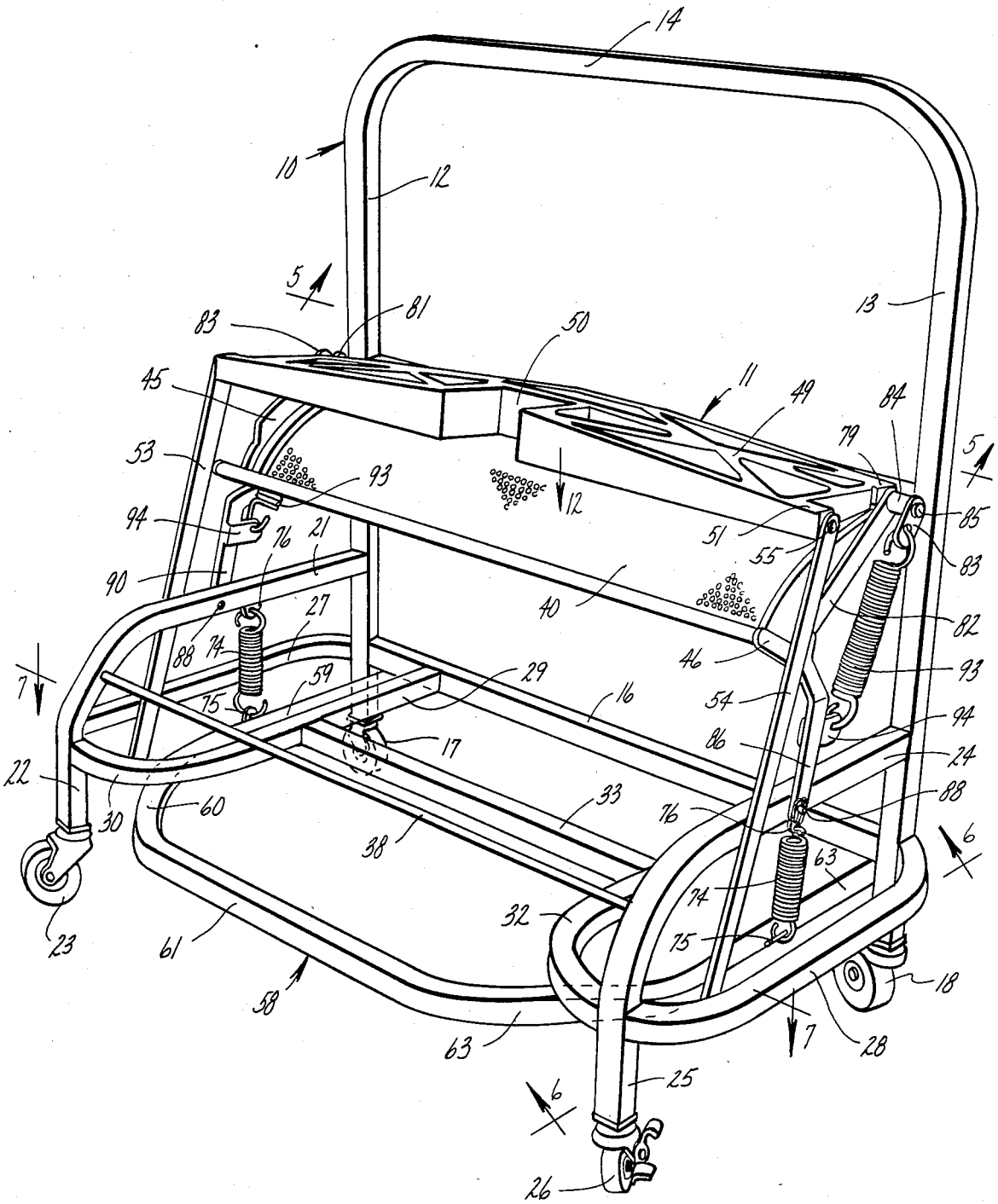
FIG. 2 is an elevation perspective view of the wet mop liquid extractor of the present invention, and showing the same with the two rectangular pails removed.
Figure 5:
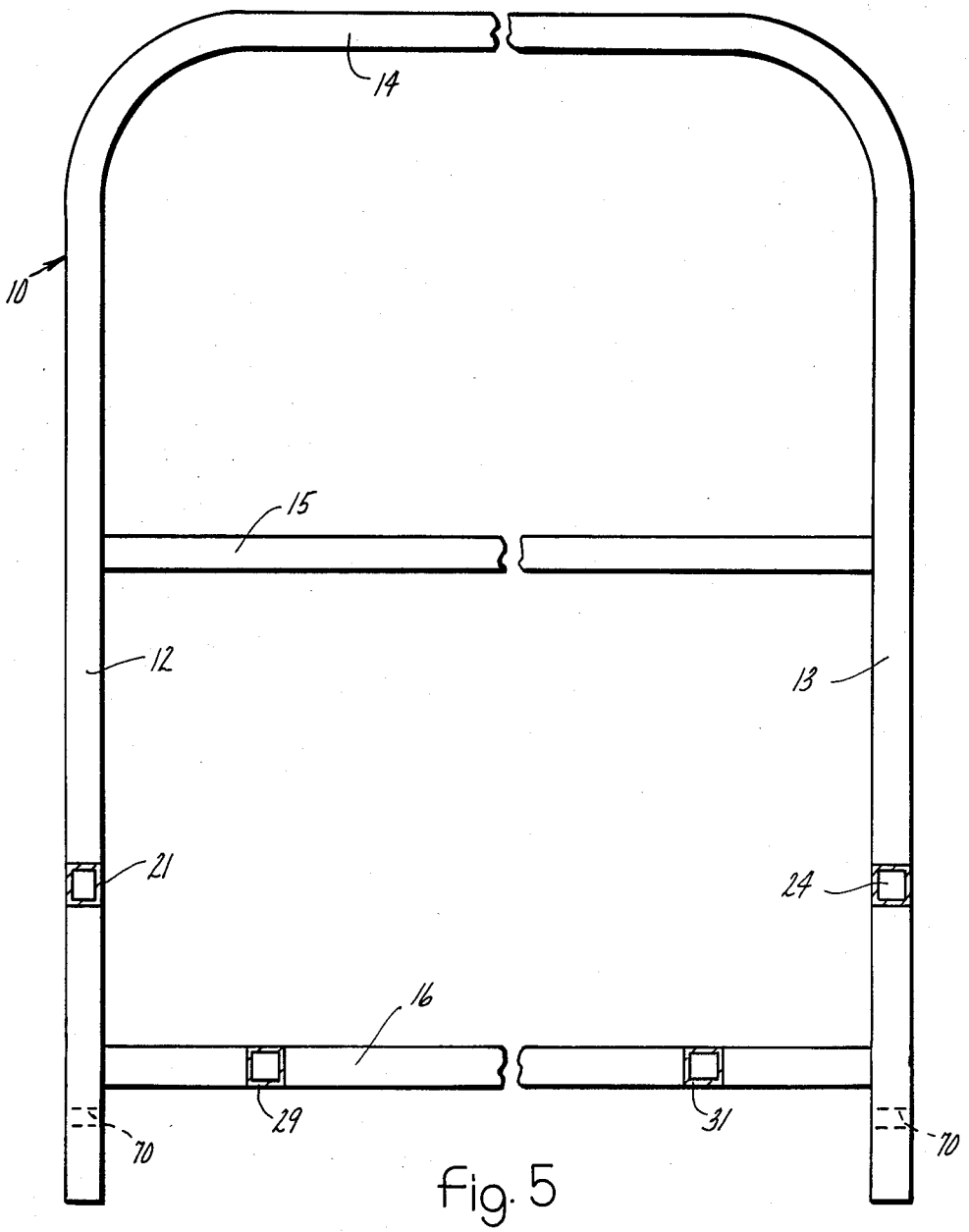
FIG. 5 is a fragmentary, broken, elevation view, with parts removed, of the rear vertical portion of the supporting frame for the liquid extractor, taken along the line 5—5 of FIG. 2, and looking the in the direction of the arrows.
Figure 6:
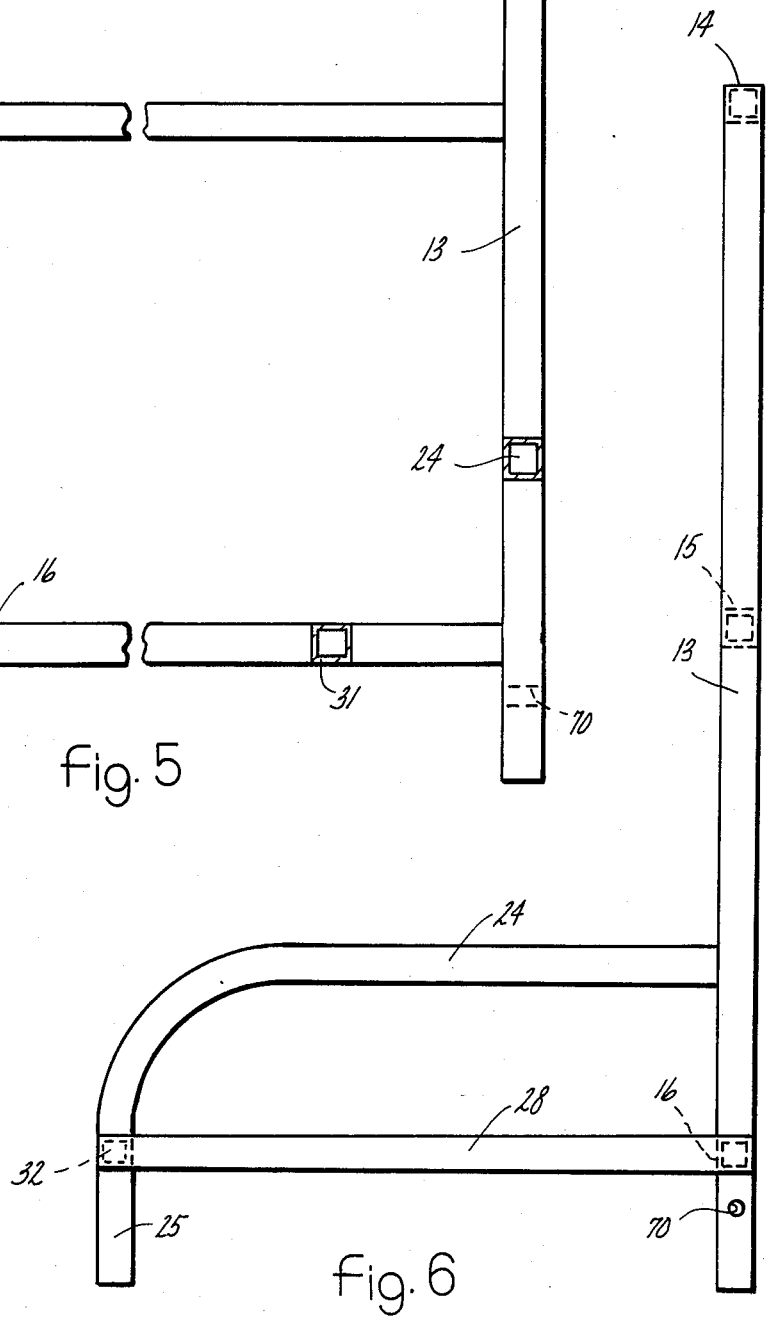
FIG. 6 is a right side elevation view of the support frame for the liquid extractor illustrated in FIG. 2, taken along the line 6—6 thereof, and looking in the direction of the arrows.

Referring now to the drawings, an in particular to FIGS. 1, 2 and 5, the numeral 10 generally designates a rollable support cart which carries a liquid extractor means, generally indicated by the numeral 11. As best seen in FIG. 5, the frame support cart 11 includes a pair of vertical, elongated, spaced apart support members 12 and 13 which are integrally attached at their upper ends to a transverse or horizontal handle member 14. A pair of vertically spaced apart, transverse support members 15 and 16 are mounted between the two vertical support members 12 and 13, and they are fixedly attached thereto by any suitable means, as by welding. The last described parts of the support cart, and the hereinafter described support cart parts, may be made from any suitable material as, for example, tubular stainless steel. As indicated in FIG. 2, a suitable static free castor 17 and 18 is operatively mounted on the lower end or leg of each of the vertical support members 12 and 13.

Figure 7:
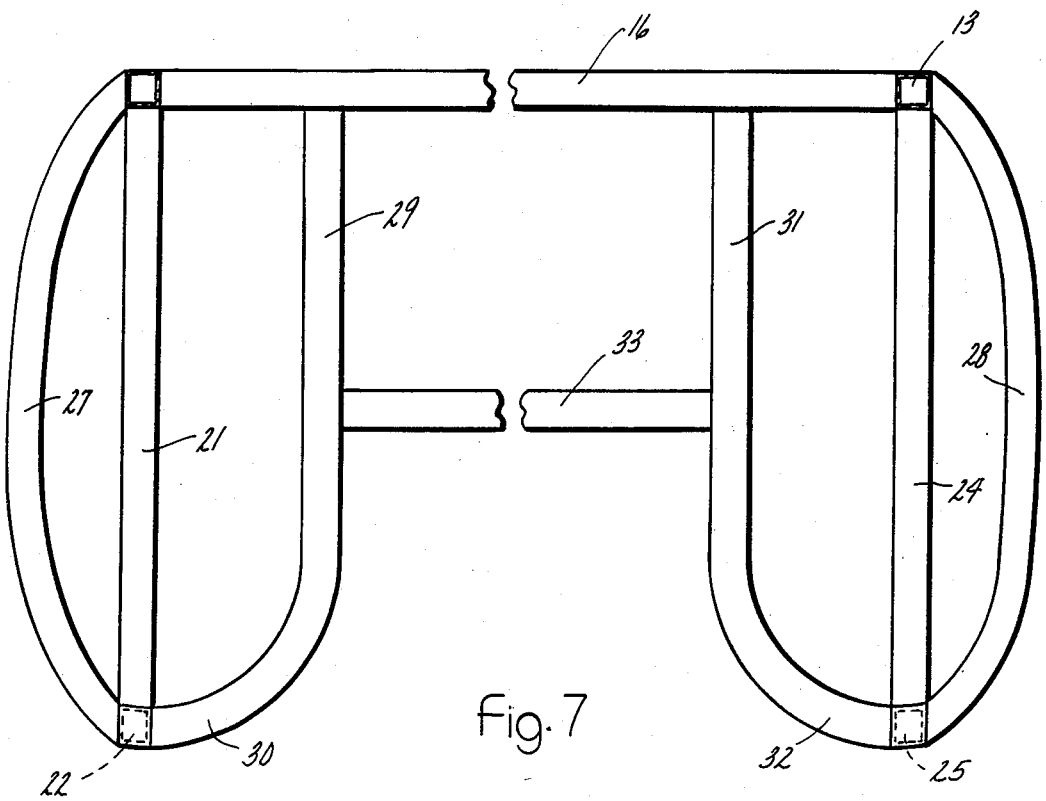
FIG. 7 is a broken, horizontal view of the lower portion of the support frame employed in the invention, taken along the line 7—7 of FIG. 2, and looking in the direction of the arrows.

As best seen in FIG. 2, the support cart includes a left horizontal side arm 21 which is fixedly connected, as by welding, at its rear end to the vertical frame member 12. The front end of the cart frame side arm 21 is curved downwardly, and terminates at a leg 22, on the lower end of which is operatively mounted a suitable static free castor 23. The support cart also includes a right horizontal side arm 24, which has its rear end fixedly secured, as by welding to the vertical frame member 13. The front end of the cart frame side arm 24 curves downwardly, and the lower end thereof forms a leg 25, on the lower end of which is operatively mounted a suitable static free roller 26. As shown in FIGS. 2 and 7, the support cart is provided with a left and right horizontal, outwardly extended fender or bumper 27 and 28, respectively. The fenders 27 and 28 are fixedly secured at their rear ends to the vertical support members 12 and 13, respectively, and their front ends are fixedly secured, as by welding, to the front leg members 22 and 25, respectively.

As best seen in FIG. 7, the support cart is provided with a pail or bucket supporting platform comprising a left horizontal member 29 and a right horizontal member 31, and these members are fixedly secured, as by welding, to the inner side of the transverse support member 16. The front ends 30 and 32 of the support members 29 and 31 are curved outwardly, and are fixedly secured (FIG. 2), as by welding, to the cart legs 22 and 25, respectively. A transversely disposed, horizontal support member 33 is fixedly connected between the left and right pail support platform members 29 and 31, and they are fixedly secured to the last mentioned support members by any suitable means, as by welding.

Figure 4:
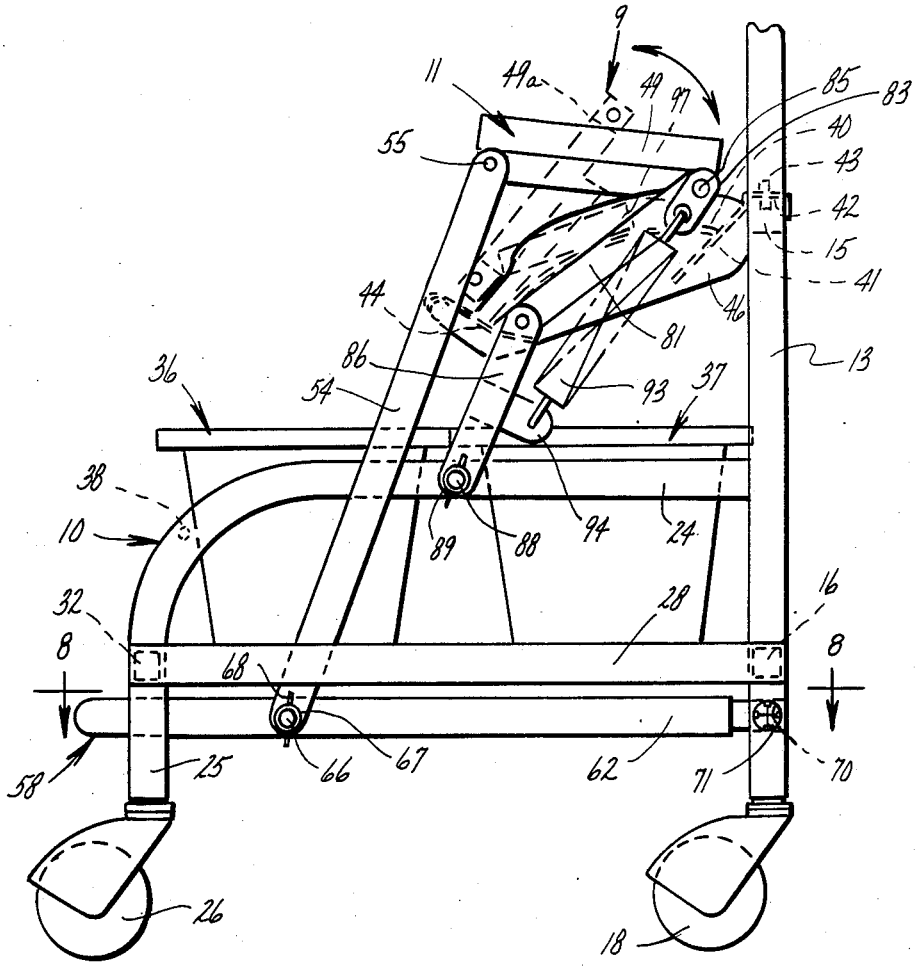
FIG. 4 is a side elevation view of the wet mop liquid extractor illustrated in FIG. 1, taken in the direction of the arrow marked "4".

As shown in FIGS. 1 and 4, the aforementioned support platform is adapted to have releasably seated thereon a pair of elongated, rectangularly shaped pails or buckets, generally indicated by the numerals 36 and 37. The pails 36 and 37 are retained against forward sliding movement by a transverse retainer bar 38, which has its outer ends fixedly connected, as by welding, to the curved front end leg portions 22 and 25, of the support side arms 21 and 24, respectively.

As shown in FIGS. 1 and 4, the liquid extractor means 11 includes a fixed, convexly curved, upwardly, perforated metal plate 40 which is carried on the support cart in a position spaced above the rear pail or bucket 37. As shown in FIG. 4, the rear end of the perforated plate 40 is fixedly secured to a downwardly and inwardly sloping rear guard splash plate 41 for directing fluid forwardly and downwardly into the rear catch pail or bucket 37. The rear guard splash plate 41 extends transversely for the complete length of the perforated plate 40. As shown in FIG. 4, the upper end of the guard splash plate 41 is integrally attached to an elongated, U-shaped, downwardly facing retainer member 42, which is seated on the transverse frame member 15, and which is fixedly secured thereto by a plurality of suitable machine screws 43 (FIG. 1). As shown in FIG. 4, the front end of the perforated pressure plate 40 is fixedly secured to the upper side of a front guard splash plate 44, for directing fluid rearwardly and downwardly into the rear catch pail or bucket 37. As shown in FIG. 4, the front end of the guard splash plate 44 is extended upwardly and forwardly, and turned downwardly and under. As shown in FIGS. 2 and 4, the perforated pressure plate 40 is provided with a pair of left and right side plates 45 and 46, which are fixedly secured to the respective sides of the perforated pressure plate 40 and the front and rear guard splash plates 44 and 41, respectively, by any suitable means, as by welding.

Figure 9:
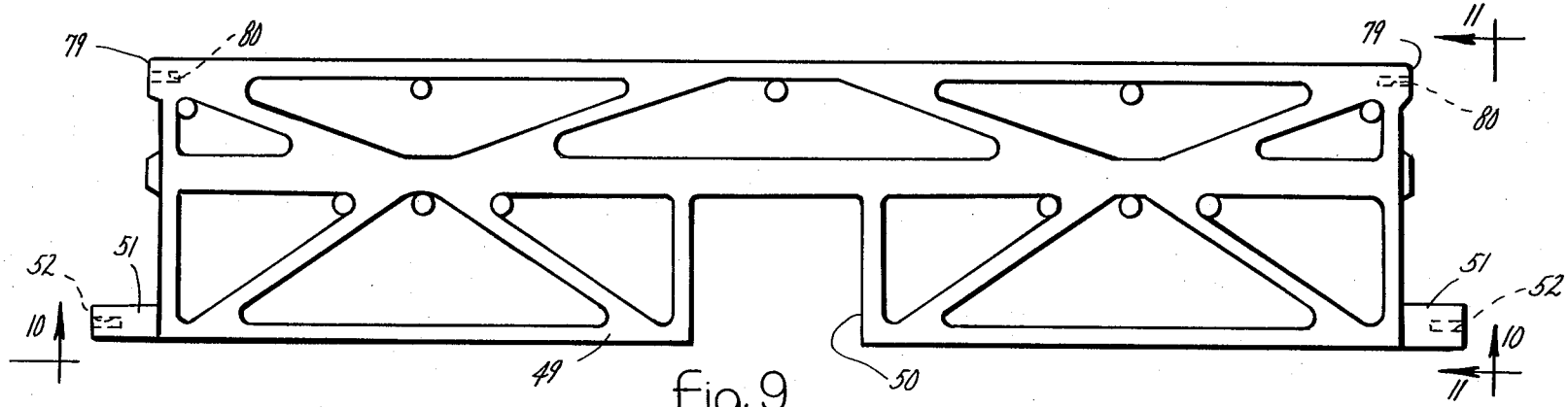
FIG. 9 is a top plan view of a movable pressure plate employed in the invention, taken in the direction of the arrow marked "9" in FIG. 4.

As shown in FIGS. 1 and 9, the liquid extractor means 11 includes a movable pressure plate 49 which is adapted to be moved over the fixed pressure 40 in a pivoting and rolling action relative to a short yarn wet mop disposed on the fixed pressure plate 40, and as more fully explained hereinafter. The movable pressure plate 49 is provided with a U-shaped recess 50 on the front side thereof for passage therethrough of the handle of a wet mop. The front end of the movable pressure plate 49 is supported by the following described structure.

Figure 10:
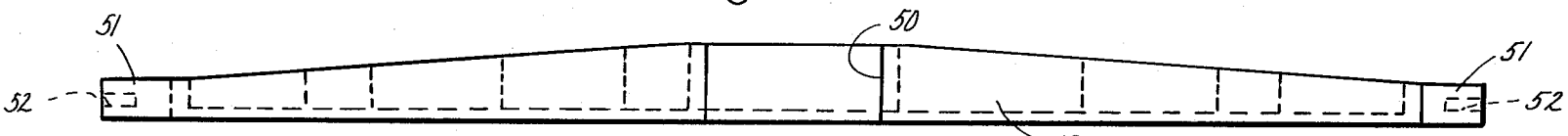
FIG. 10 is a front elevation view of the movable pressure plate illustrated in FIG. 9, taken along the line 10—10 thereof, and looking in the direction of the arrows.
Figure 11:
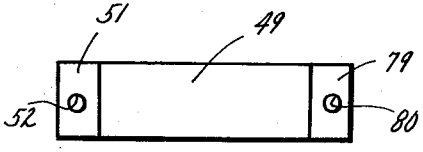
FIG. 11 is a right side elevation view of the movable pressure plate illustrated in FIG. 9, taken along the line 11—11 thereof, and looking in the direction of the arrows.
Figure 12:
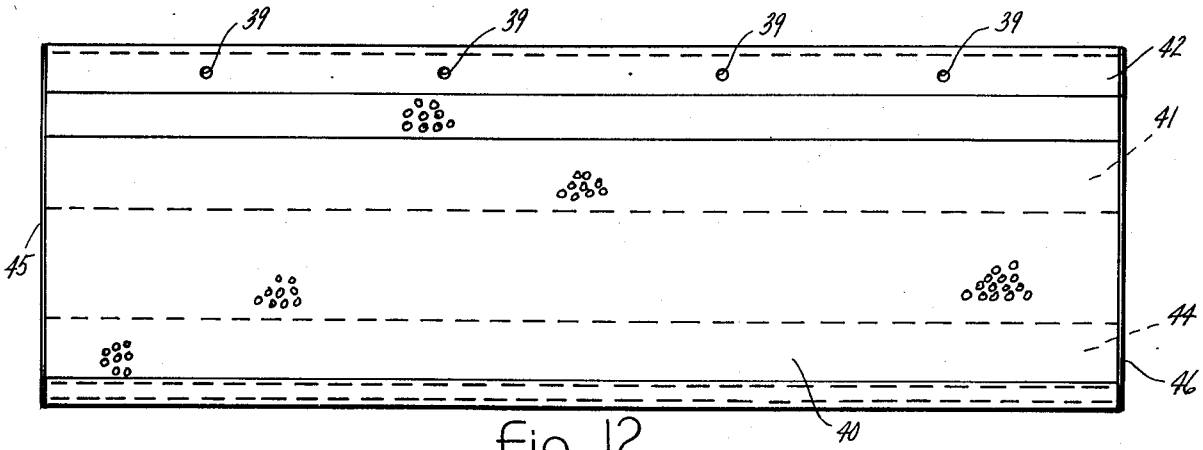
FIG. 12 is a top plan view of a stationary, perforated pressure plate employed in the invention.

As best seen in FIGS. 9 through 11, the movable pressure plate 48 is provided on the front end corners with an integral projection 51, into each of which is formed an inwardly extended bore 52. As shown in FIGS. 1 through 4, the front end of the movable pressure plate 49 is supported by a pair of left and right elongated operating levers 53 and 54. The upper ends of the operating levers 53 and 54 are secured to the movable pressure plate 49 by a suitable mounting pin 55 which passes through a suitable hole in the upper end of each of the operating levers 53 and 54, and into the adjacent bore 52 in the movable pressure plate projections 51.

Figure 8:
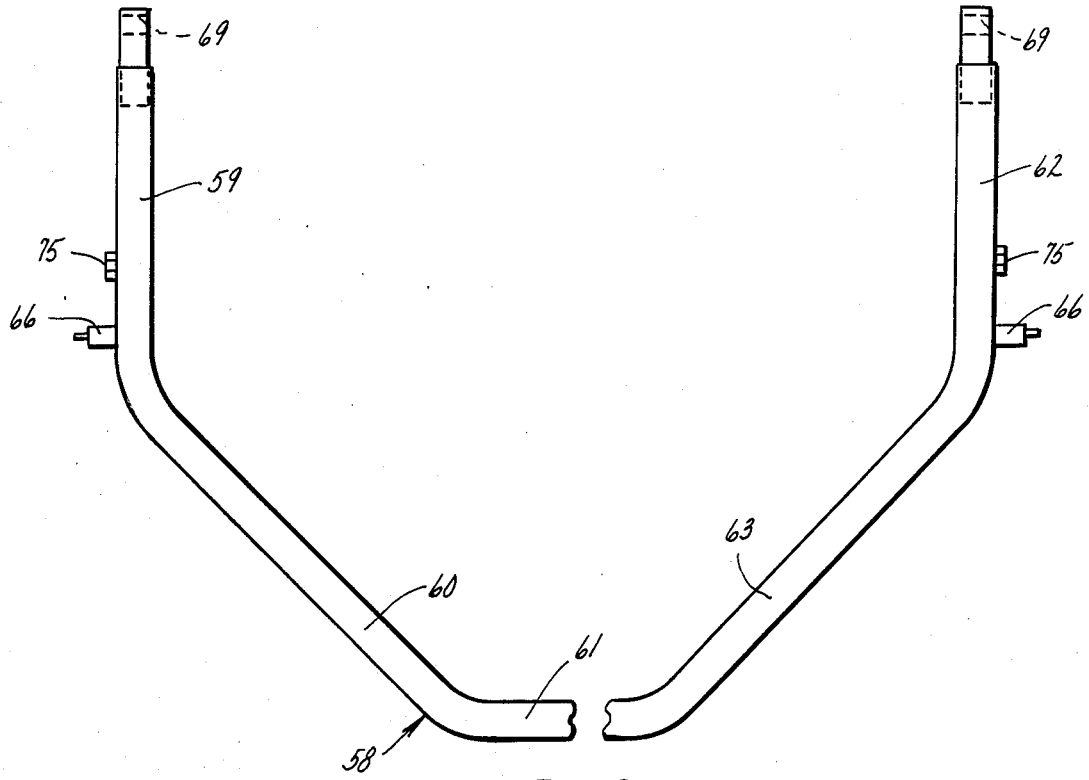
FIG. 8 is a broken, top plan view of the foot operated pedal employed in the invention, taken along the line 8—8 of FIG. 4, and looking in the direction of the arrows.

The lower end of each of the operating levers 53 and 54 is rotatably mounted on a foot pedal, which is generally indicated by the numeral 58. As shown in FIG. 8, the foot pedal 58 includes a forwardly extended left side lever 59 which has an integral forwardly and inwardly sloping portion 60 that is integral with a front, transverse portion 61. The foot pedal 58 further includes a forwardly extended right side lever 62, which has an integral front end portion 63 that extends forwardly and slopes sidewardly inward for integral connection to the front transverse portion 61. The foot pedal 58 is provided with a fixedly mounted shaft 66 on the outward side of each of the left and right lever portions 59 and 62. As shown in FIG. 4, the lower end of the operating lever 54 is provided with a hole through which is received a right side shaft 66 on the foot pedal lever portion 62. The lever 54 is secured in place on the pivot shaft 66 by a suitable washer 67 and a cotter key 68. It will be understood that the left side operating lever 53 is connected in a similar fashion to the shaft 66 on the left side lever 59 of the foot pedal 58.

The rear end of each of the foot pedal arms 59 and 62 are pivotally mounted to the support frame vertical members 12 and 13 by the following described structure. As shown in FIG. 8, a transverse hole 69 is formed through the rear ends of each of the foot pedal arms 59 and 62. As shown in FIG. 5, a hole 70 is formed through each of the lower ends of the vertical support frame members 12 and 13. As illustrated in FIG. 4, the foot pedal arm 62 is pivotally mounted to the vertical frame member 13 by a suitable pivot pin member 71 which extends through the hole 70 in the support frame member 13 and into operative engagement with the hole 69 in the foot pedal arm 62. It will be understood that the foot pedal arm 59 is pivotally mounted in an identical manner to the left support frame vertical member 12 by a similar pivot pin 71.

As best seen in FIG. 2, the foot pedal 58 is retained in an inoperative upper position by a pair of return springs 74. The upper ends of the return springs 74 are each connected to a lug 76 which are fixedly secured to the frame left and right side arms 21 and 24. The lower ends of the return springs 74 are each attached to lugs 75 which are fixed to the foot pedal left and right arms 59 and 62, respectively.

The rear end of the movable pressure plate 49 is pivotally and movably supported by the following described structure. As shown in FIGS. 9 and 11, the movable pressure plate 49 has an integral projection 79 formed at the side of each of the rear corners. A transverse bore 80 is formed in each of the projections 79 and they extend inwardly into the body of the movable pressure plate 49. As indicated in FIG. 2, the rear end of the movable pressure plate 49 is pivotally supported by a left upper pivot lever 81 and a right upper pivot lever 82. As shown in FIG. 2, the upper end of the right pivot lever 82 is pivotally attached to the movable pressure plate 49 by a suitable mounting pin 85, which also pivotally retains a spacer sleeve 84 and a spring attachment lug 83 on the movable pressure plate 49. As shown in FIG. 1, the lower end of the right upper pivot lever 82 is pivotally connected to the upper end of a lower right pivot lever 86 by a suitable pivot pin 87. As shown in FIG. 1, the lower end of the lower right pivot lever 86 is pivotally attached to the support cart frame side arm 24 by a suitable pivot pin 88 and a washer and cotter pin retaining means, indicated by the numeral 89. The left side upper pivot lever 81 is similarly connected to the support cart frame left side arm 21 by identical structure, which includes a lower left pivot lever 90.

As shown in FIG. 1, a pressure spring 93 is mounted on the right side of the movable pressure plate 49. The upper end of the pressure spring 93 is attached to the spring attachment lug 83 on the shaft 85. The lower end of the pressure spring 93 is attached to a spring attachment lug 94 which is fixedly attached to the lower right pivot lever 86. A similar pressure spring 93 is mounted in the same manner on the left side of the movable pressure plate 49, between the pivot pin 85 on the left side of said plate and the left side lower pivot lever 90 (FIG. 2).

Figure 3:
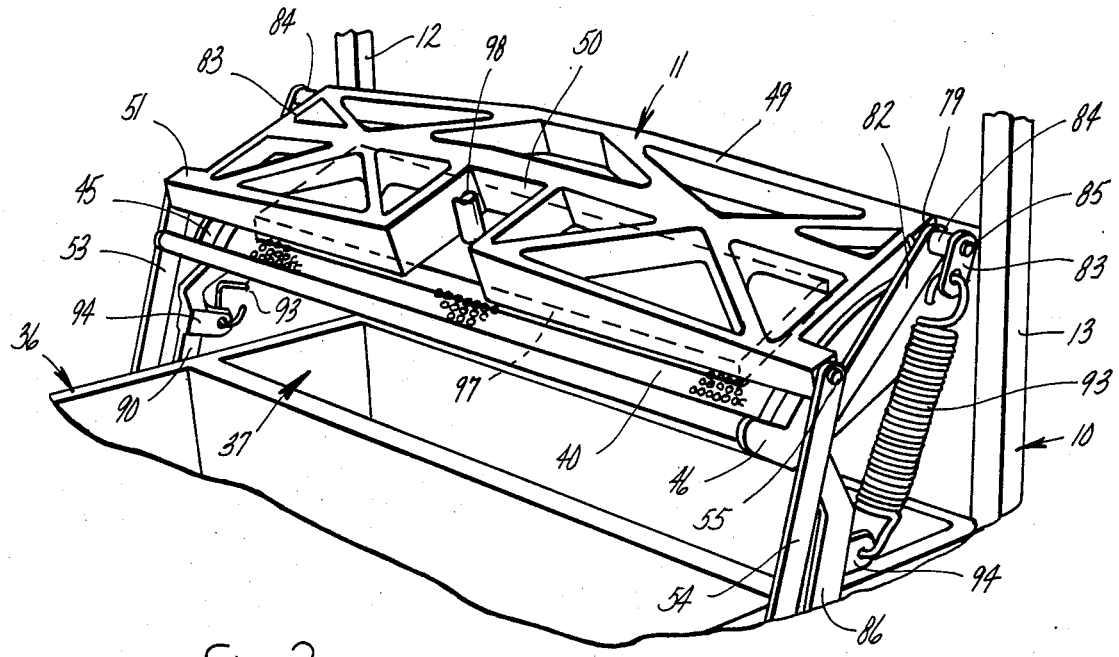
FIG. 3 is a fragmentary, elevation perspective view of the liquid extractor means employed in the invention, and showing the same in a closed position.

In use, the operator would first put his short yarn wet mop in the front pail or bucket 36, which would be filled with suitable clean wash water that may contain a germicidal or other desired chemicals. The operator then places the wet mop on the curved fixed pressure plate 40 in a position substantially as indicated by the numeral 97 in FIG. 4, with the handle 98 extending upwardly through the opening 50 in the movable pressure plate 49, as illustrated in FIG. 3. The operator then exerts a pressure with his foot on the foot pedal 58 to move it downwardly against the action of the return springs 74. The downward movement of the foot pedal 58 moves the operating levers 53 and 54 downwardly, and the lower ends of these levers swing in an arc rearwardly and downwardly while the upper ends thereof swing in an arc downwardly and forwardly, so as to move the movable pressure plate 49 from the initial solid line position shown in FIG. 4 to the dotted line position in FIG. 4, as indicated by the numeral 49*a*. It will be seen, that as the movable pressure plate 49 moves from its initial position shown in FIG. 4 to the dotted line position 49*a* shown in FIG. 4, that a rolling line pressure or walking pressure is exerted across the length of the mop 97 to squeeze the clean solution from the mop so that it will drain downwardly, and be directed by the splash guards 41 and 44 into the rear rectangular pail or bucket 37. It will be seen that as the upper pivot levers 81 and 82 pivot about the pivot pins 89, as the movable pressure plate 49 is moved forwardly and downwardly, that the pressure springs 93 are expanded or stretched lengthwise, so as to create a downwardly directed squeezing pressure on the mop 97 as the movable pressure plate 49 rolls across the semicylindrical curved fixed pressure plate 40. It will be understood that the squeezing pressure exerted by the pressure springs 93 may be varied by varying size of the springs 93. It will be seen that the movable pressure plate 49 exerts a squeezing the liquid extracting pressure along a small area of the mop 97, at any one time, to maximize the squeezing pressure, so that the liquid is squeezed out to a condition whereby the mop is merely damp. The squeezing action starts from the back of the mop 97 and works toward the front side thereof, so that the extracted solution does not drain back against itself. The water that is cause in the rear pail or bucket 37 is almost as clean as the water in the front bucket 38 because the operator lever puts a dirty wet mop into either one of the buckets. For example, in a mopping operation in the hospital, a dirty mop head is removed from the mop holder or carrier and thrown into a collection bag. A clean mop head is mounted on the mop holder and the mop is inserted into the clean water in the front bucket 36 and the excess clean water is then squeezed out by the aforementioned extraction means, and it falls into the rear collection bucket 37.

What is claimed is:

1. A wet mop liquid extractor comprising:
   (a) a support frame;
   (b) a fixed, perforated, arcuately curved upwardly, pressure plate mounted on said support frame;
   (c) a movable pressure plate, pivotally and arcuately movable, operatively mounted on said support frame in a position above said fixed pressure plate;
   (d) means for moving said movable pressure plate from an initial position through a rolling, squeezing engagement with a wet mop placed on the fixed pressure plate so that pressure is applied against a small area of the mop at any one time to maximize the squeezing pressure on the mop to extract the liquid therefrom;
   (e) means for exerting a downward pressure on the movable pressure plate when it is moved through a liquid extraction movement over a wet mop; and,
   (f) means for returning said movable pressure plate to its initial position after liquid extractions movement.

2. A wet mop liquid extractor as defined in claim 1, wherein;
   (a) said means for exerting a downward pressure on the movable pressure plate comprises a spring means.

3. A wet mop liquid extractor as defined in claim 1, wherein:
   (a) said support frame removably supports a catch pail positioned below the fixed pressure plate for catching liquid extracted from a wet mop on the fixed pressure plate.

4. A wet mop liquid extractor as defined in claim 3, wherein:
   (a) said support frame removably supports a fresh liquid pail for holding a supply of claim liquid, into which a wet mop is first dipped before placing the mop on the fixed pressure plate for extracting the liquid from the mop to leave it in a damp condition for a mopping operation.

5. A wet mop liquid extractor as defined in claim 3, wherein:
   (a) said fixed pressure plate is provided with guard splash plates for directing liquid extracted from a wet mop downwardly into the catch pail.

6. A wet mop liquid extractor as defined in claim 1, wherein:
   (a) said means for moving said movable pressure plate into a rolling, squeezing engagement with a wet mop includes a foot operated pedal means.

7. A wet mop liquid extractor as defined in claim 1, wherein:
   (a) said support frame is provided with roller means.

* * * * *

UNITED STATES PATENT OFFICE

CERTIFICATE OF CORRECTION

Patent No. 4,707,877 Dated November 24, 1987

Inventor(s) Dana K. Griffin

It is certified that error appears in the above-identified patent and that said Letters Patent are hereby corrected as shown below:

Column 2, line 41, numeral "11" should be --10--.
Column 3, line 60, after "pressure" insert --plate--.
Column 4, line 2, numeral "48" should be --49--.
Column 5, line 64, delete "the" and insert --and--.
Column 6, line 3, delete "cause" and insert --caught--.
Column 6, line 5, delete "lever" and insert --never--.
In the Claims, column 6, line 33, "extractions" should be --extraction--.
In the Claims, column 6, line 49, delete "claim" and insert --clean--.

Signed and Sealed this

Twelfth Day of April, 1988

*Attest:*

DONALD J. QUIGG

*Attesting Officer* *Commissioner of Patents and Trademarks*